United States Patent [19]

Helms

[11] 4,044,940

[45] Aug. 30, 1977

[54] WRAPPER BLANK

[75] Inventor: C. R. Helms, Collegeville, Pa.

[73] Assignee: Container Corporation of America, Chicago, Ill.

[21] Appl. No.: 718,053

[22] Filed: Aug. 26, 1976

[51] Int. Cl.[2] ..... B65D 5/02

[52] U.S. Cl. ..... 229/40; 206/140

[58] Field of Search ..... 229/40; 206/140, 141, 206/154

[56] References Cited

U.S. PATENT DOCUMENTS

| | | | |
|---|---|---|---|
| 3,029,999 | 4/1962 | DePaul | 229/40 |
| 3,040,962 | 6/1962 | DePaul | 229/40 |
| 3,042,283 | 7/1962 | DePaul | 229/40 |
| 3,122,302 | 2/1964 | Wood | 229/40 |
| 3,142,378 | 7/1964 | Lengsfield | 229/40 UX |
| 3,652,005 | 3/1972 | Morgese | 229/40 |
| 3,767,042 | 10/1973 | Ganz | 229/40 X |

*Primary Examiner*—Davis T. Moorhead

*Attorney, Agent, or Firm*—Carpenter & Ostis

[57] ABSTRACT

A wrapper blank for a group of containers consists of main, side and closing panels foldably connected to define a tube. The edges of all the panels are provided with cutaway portions to provide a scallop-like configuration along the edge of the blank, each of the cutaway portions being generally U-shaped with divergent sides extending toward the fold lines connecting the panels and defining wrapper elements folded to position to restrain movement of the containers within the wrapper.

1 Claim, 5 Drawing Figures

WRAPPER BLANK

BACKGROUND OF THE INVENTION

1. Scope of the Invention

The structure according to the present invention relates to wrappers for enclosing beverage containers generally known in the trade as a six-pack.

2. The Prior Art

The structure according to the present invention constitutes an improvement over Wood U.S. Pat. No. 3,122,302, there being shown in this patent a wrapper having a scallop-like configuration; however, the structure of Wood comprehends the securement of the containers within the wrapper by elements disposed at the fold lines of the wrapper, these being of a form to engage the chimes of the containers.

SUMMARY OF THE INVENTION

The invention herein comprehends a structure for enclosing a number of generally cylindrical beverage containers within a wrapper, the containers being confined by elements adapted to embrace the endmost container in part and to prevent the unintended movement of the containers within the wrapper.

THE DRAWING

Figure 1:
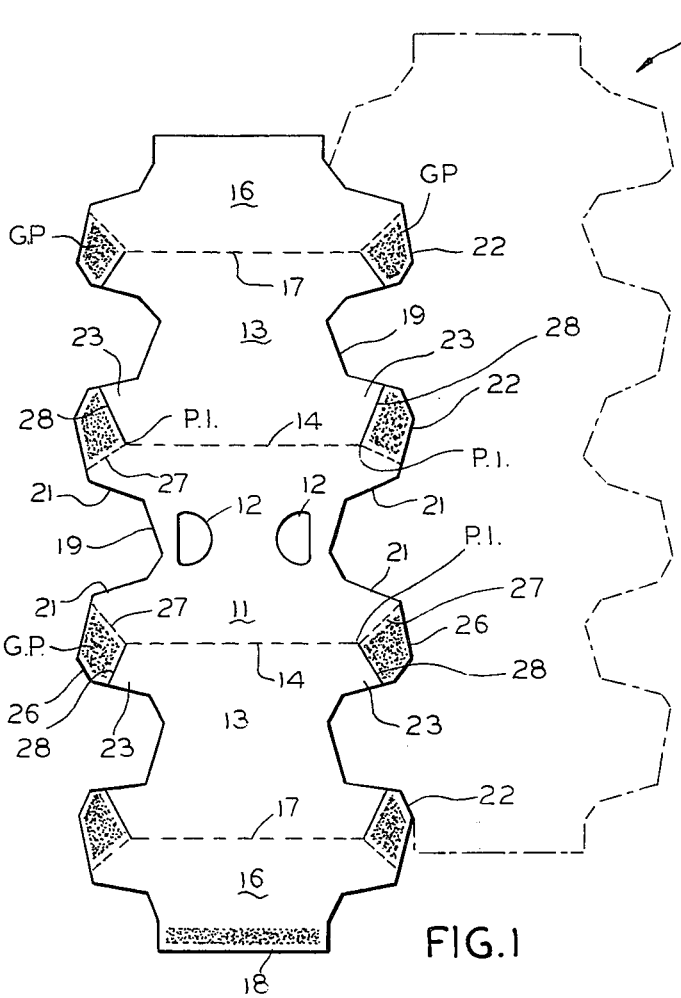
FIG. 1 is a plan view of a wrapper blank adapted to be folded into a wrapper around containers, said wrapper blank having the improvements according to the present invention embodied therein.
Figure 5:
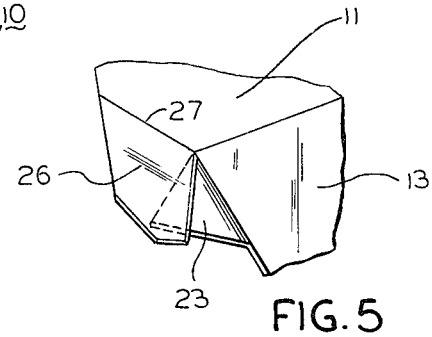
FIG. 5 is a detailed isometric view showing certain details.
Figure 2:
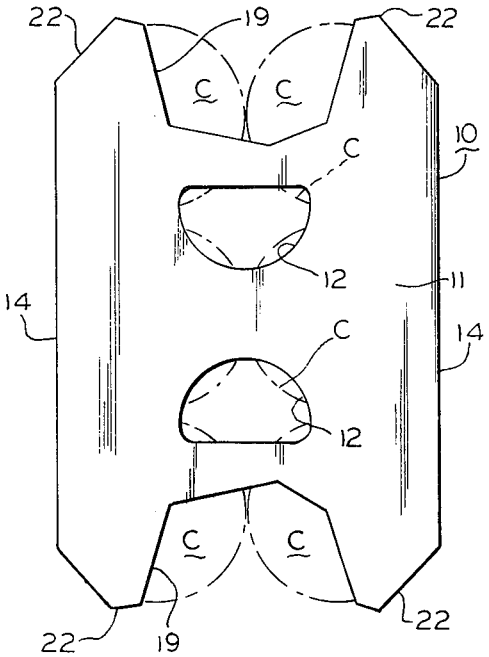
FIG. 2 is a plan view showing the wrapper of FIG. 1 formed as a tube and enclsosing a group of containers therein.
Figure 3:
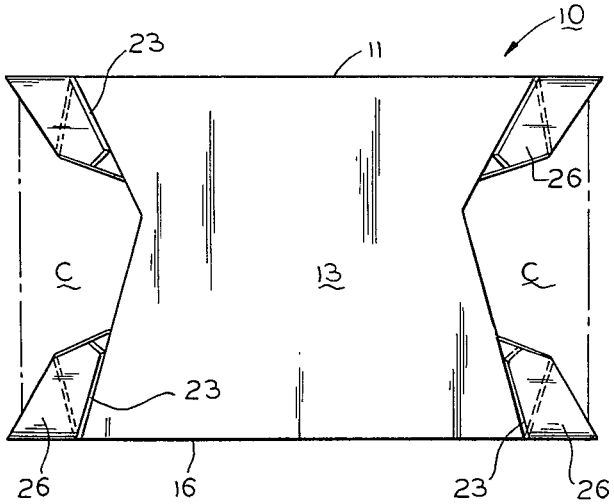
FIG. 3 is a side view of FIG. 2.
Figure 4:
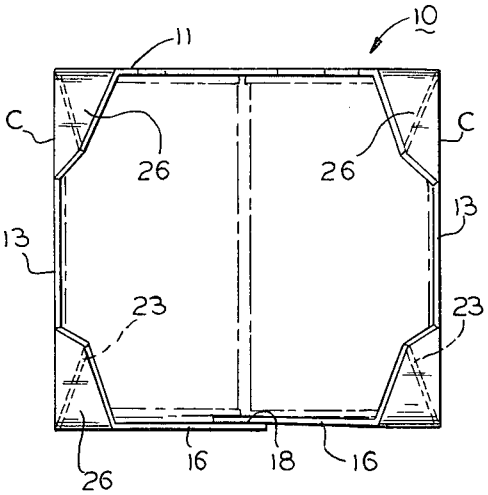
FIG. 4 is an end view thereof.

The improved wrapper blank according to the present invention is denoted by the reference numeral 10 and may be produced in nesting relationship with like container blanks. Each of the blanks 10 includes a main panel 11 having holes 12 therein for grasping same when the blank 10 is wrapped around a plurality of containers C.

Side panels 13 are foldably connected to opposite edges of the main panel 11 along fold lines 14, and closure panels 16 are foldably connected to the side panels 13 along fold lines 17, the two closing panels 16 being joined to define a tube by means of a glue panel 18.

Wrapper 10 is provided in each of the panels thereof with cutaway portions 19 to form a scallop like configuration along both edges of blank 10. Each of the cutaway portions 19 is generally U-shaped with divergent sides 21 extending towards the fold lines 14 and 17 joining panels 11, 13 and 16 and defining adjacent such fold lines wrapper elements indicated generally by the reference numeral 22 and adapted to be folded into position to restrain movement of the containers C within the wrapper 10 when folded about such container group.

Each of the wrapper elements 22 comprises a first closure tab 23 extending from the side panels 13 at the ends thereof, and a second closure tab 26 folded with respect to main panel 11 and closing panel 16 along a fold line 27 extending at an angle to the fold lines 14 and 17 as the case may be.

The first and second closure tabs 23 and 26 are each separated by a cut line 28 extending from the edges of the wrapper elements 22 to the fold lines 14 and 17 at the side panels 13, the fold lines 27 and the cut lines 28 meeting at a common point of intersection PI at the fold lines 14 and 17.

Each of the second closure tabs 26 is provided with a glue patch GP adapted to be folded into lapping engagement with the first closure tab 23 and to bear against the endmost container C of the group within the wrapper 10 to restrain the movement thereof. The configuration of the tabs 23 and 26 is such when tab 26 is secured to tab 23 there is substantial bearing against the upper and lower ends of the containers C to prevent the movement thereof within the wrapper 10 when folded to define a tube as previously described.

I claim:

1. A wrapper blank for a group of containers, said blank comprising:

a. a main panel;

a pair of side panels foldably connected to side edges of said main panel;

c. a pair of closing panels foldably connected to said side panels remote from said main panel and joined to define a tube;

d. the edges of all of said panels being pivoted with cutaway portions to form a scallop-like configuration along both edges of the blank;

e. each of said cutaway portions being generally U-shaped with divergent sides thereof extending toward the fold lines joining said panels and defining at such fold lines wrapper elements folded into position to restrain movement of the containers within said wrapper;

f. each of said wrapper elements comprising:

1. a first closure tab extending from said side panels adjacent the ends thereof;
2. a second closure tab folded with respect to said main and closing panels along fold lines extending at an angle to the fold lines of said panels;
3. said first and second closure tabs being separated by a cut line extending from the edges of the wrapper elements to the fold lines at said side panels;

g. said second closure tab being folded into lapping engagement with said first closure tab and being secured together to bear against the endmost containers to restrain movement thereof.

* * * * *